United States Patent [19]

Garner

[11] 4,203,786

[45] May 20, 1980

[54] POLYETHYLENE BINDER FOR PYROTECHNIC COMPOSITION

[75] Inventor: Eugene F. Garner, Canyon Country, Calif.

[73] Assignee: Allied Chemical Corporation, Morris Township, Morris County, N.J.

[21] Appl. No.: 913,915

[22] Filed: Jun. 8, 1978

[51] Int. Cl.[2] ..... C06B 45/10

[52] U.S. Cl. ..... 149/19.91; 149/82; 149/83

[58] Field of Search ..... 149/19.91, 82, 83

[56] References Cited

U.S. PATENT DOCUMENTS

| | | | |
|---|---|---|---|
| 3,498,856 | 3/1970 | Harris | 149/19.91 |
| 3,657,027 | 4/1972 | Horsey et al. | 149/19.91 |
| 3,692,495 | 9/1972 | Schneiter et al. | 149/19.5 |
| 3,723,205 | 2/1973 | Scheffee | 149/19.91 |
| 3,740,279 | 6/1973 | Levering | 149/19.91 |
| 3,806,461 | 4/1974 | Hendrickson | 252/188.3 R |
| 3,890,173 | 6/1975 | Filter et al. | 149/19.91 |
| 3,960,946 | 6/1976 | Dewitt et al. | 149/19.91 |
| 4,128,996 | 12/1978 | Garner | 149/19.91 |

*Primary Examiner*—Edward A. Miller

*Attorney, Agent, or Firm*—Roger H. Criss

[57] ABSTRACT

Use of high density polyethylene as a fuel/binder in pyrotechnic compositions suitable for use in inflating vehicle occupant safety restraints.

5 Claims, No Drawings

POLYETHYLENE BINDER FOR PYROTECHNIC COMPOSITION

BACKGROUND OF THE INVENTION

1. Field of the Invention

This invention relates to pyrotechnic compositions containing high density polyethylene as a fuel binder.

2. DESCRIPTION OF THE PRIOR ART

Various pyrotechnic propellants have been prepared for generating a gas upon combustion in order to inflate an air bag or similar safety restraint in a vehicle so as to restrain movement of an occupant in the event of a sudden deceleration of the vehicle, such as caused by a collision. In order to be employed as a pyrotechnic gas generating composition for inflatable occupant restraints, several criteria must be met. The pyrotechnic must be capable of producing non-toxic, non-flammable and essentially smokeless gases over a wide variety of temperatures and other environmental conditions. The gases that are generated must be totally ignited at a sufficiently low temperature so as not to destroy the restraint or injure the occupant. The pyrotechnic must also be safe to handle and must be capable of generating a substantial amount of gas within a very short period of time, e.g., less than about 100 milliseconds.

A wide variety of pyrotechnic compositions have been suggested for possible use for inflating vehicle occupant safety restraints. A typical pyrotechnic composition is disclosed in U.S. Pat. No. 3,897,285 to Hamilton et al., and is comprised of a fuel such as a carbonaceous material, aluminum or magnesium; and an inorganic oxidizer such as metal chlorate, a metal perchlorate, or a metal nitrate.

Another typical pyrotechnic composition is described in co-pending application Ser. No. 767,726, filed Feb. 11, 1977 and incorporated herein by reference. The pyrotechnic composition disclosed therein is comprised of an inorganic oxidizer such as a metal perchlorate and a highly oxygenated organic binder such as a polyester resin or polyacetal resin.

Although pyrotechnic compositions can be produced using a wide variety of ingredients, to obtain a wide variety of results, it has generally been the custom to use a highly oxygenated, combustible polymeric material as a binder or fuel/binder whenever one was desired.

Therefore, there is a need to produce pyrotechnic compositions containing as a binder a polymeric material having no oxygen as part of its structure.

SUMMARY OF THE INVENTION

In accordance with the present invention, high density polyethylene is provided as a fuel/binder for use in pyrotechnic compositions, wherein said compositions are comprised of about 1.0 to 10 wt. %, preferably 3 to 5 wt. % polyethylene resin and 99 to 90 wt.% inorganic oxidizer, preferably 97 to 95 wt.% inorganic oxidizer. These compositions are suitable for use in inflating vehicle occupant safety restraints such as crash bags.

DETAILED DESCRIPTION

Pyrotechnic compositions for which the presently claimed binder is suitable for use are generally any of those pyrotechnic compositions containing an oxidizer known in the art. Such pyrotechnic compositions generate a gas upon composition and are generally comprised of mixtures of chemical components such as fuels, oxidizers, coolants, and other propellant adjuvants. These compositions are capable of being activated by, for example, an electrically energized squib to generate substantial volumes of gas for inflating such devices as automobile crash bags.

Oxidizing compounds suitable for use in pyrotechnic compositions include metal peroxides such as sodium peroxide, potassium peroxide, rubidium peroxide, cesium peroxide, calcium peroxide, strontium peroxide, and varium peroxide; inorganic chlorate such as sodium chlorate, potassium chlorate, lithium chlorate, rubidium chlorate, magnesium chlorate, strontium chlorate, barium chlorate; inorganic perchlorate, such as lithium perchlorate, sodium perchlorate, potassium perchlorate, rubidium perchlorate, magnesium perchlorate, calcium perchlorate, strontium perchlorate, barium perchlorate, ferric perchlorate, and cobalt perchlorate; and metal nitrates such as lithium nitrate, sodium nitrate, potassium nitrate, copper nitrate, silver nitrate, magnesium nitrate, barium nitrate, zinc nitrate, aluminum nitrate, thallium nitrate, stannic nitrate, bismuth nitrate, manganese nitrate, ferric nitrate, ferrous nitrate and nickel nitrate. Also suitable for use are ammonium chlorate, ammonium perchlorate, ammonium nitrate, and the like.

Non-limiting examples of fuels suitable for use in pyrotechnic compositions are oxygen containing metal compounds generally used in combination with an oxidizer to produce carbon dioxide. Illustrative of such compounds are aluminum acetate, aluminum citrate, barium formate, barium acetate, barium citrate, barium butyrate, barium malonate, barium propionate, barium succinate, cadmium formate, cadmium acetate, cadmium lactate, calcium formate, calcium acetate, calcium citrate, calcium tartrate, calcium lactate, calcium benzoate, calcium salicylate, cerous acetate, cesium acid tartrate, chromic acetate, cobaltous acetate, columbium acid oxalate, cupric formate, cupric acetate, dysprosium acetate, erbium acetate, ferric acetate, ferrous formate, ferrous acetate, ferrous tartrate, ferrous lactate, gadolinium acetate, lead formate, lead acetate, lithium formate, lithium acetate, lithium citrate, lithium acid oxalate, lithium benzoate, lithium salicylate, magnesium formate, magnesium acetate, magnesium citrate, magnesium tartrate, magnesium benzoate, manganese formate, manganese acetate, manganese lactate, manganese benzoate, nickel formate, nickel acetate, potassium formate, potassium acetate, potassium acid acetate, potassium citrate, potassium tartrate, potassium acid tartrate, potassium acid oxalate, potassium benzoate, potassium acid phthalate, samarium formate, samarium acetate, silver acetate, silver citrate, silver tartrate, sodium formate, sodium acetate, sodium citrate, sodium tartrate, sodium acid tartrate, sodium acid oxalate, sodium salicylate, sodium methylate, strontium formate, strontium acetate, strontium tartrate, strontium lactate, strontium salicylate, thallium acetate, ytterbium acetate, zinc formate, and zinc acetate also comprises: aluminum citrate, barium formate, barium citrate, calcium formate, calcium citrate, calcium acid tartrate, chromic acetate, cupric formate, ferrous tartrate, lithium formate, lithium acid oxalate, lithium citrate, magnesium formate, magnesium citrate, magnesium tartrate, manganese formate, nickel formate, potassium formate, potassium acid oxalate, potassium citrate, potassium tartrate, potassium acid tartrate, silver citrate, silver tartrate, sodium formate, sodium acid oxalate, sodium citrate, sodium tartrate, sodium acid tartrate, strontium formate, strontium tartrate, zinc formate and zinc oxalate.

It is also within the scope of the present invention that a coolant such as calcium hydroxide, magnesium chloride, calcium carbonate, or magnesium carbonate, as well as pigments such as carbon black can be incorporated into the presently claimed compositions.

The term "polyethylene" as used herein includes homopolymers of ethylene as well as copolymers obtained by reacting ethylene with a small amount of a comonomer. Non-limiting examples of such comonomers include $C_3$ to $C_8$ 1-alkenes such as propylene, butene-1,2-methylpropene-1, 4-methylpentene-1, and pentene-1 and the like, as well as mixtures thereof. Generally the copolymer contains at least 85 weight percent, and preferably not less than 96 weight percent of polymer units derived from ethylene. Such copolymers have essentially the same characteristics as the ethylene homopolymer of the same molecular weight, e.g. the preforming and sintering characteristics are the same.

The polyethylene resin suitable for use as starting material in the present invention may be prepared by any conventional procedure. One such procedure is a low pressure ethylene polymerization process using a chromium oxide catalyst on a silica or silicaalumina support in paraffinic or cycloparafinnic solvent thereby forming polyethylene in solution or as discrete particles in a hydrocarbon slurry. Another procedure suitable for preparing polyethylene suitable for use herein is the Ziegler process which teaches the use of an active metal alkyl catalyst, or by such other processes as described in U.S. Pat. No. 3,050,514 or especially the process outlined in U.S. Pat. No. 3,051,993. The latter process involves at least intermittently contacting anhydrous oxygen-free ethylene in the gaseous phase with an inorganic, porous, frangible, solid contact catalyst prepared from an inorganic compound of chromium and oxygen and an active metal alkyl.

Generally the polyethylene resins suitable for use as fuel/binders in the present invention have densities from about 0.92 to 0.97 at 23° C., as determined by ASTM Method D792. Their crystalline melting point is in the order of about 275° F.

The method for preparing the pyrotechnic composition is not critical to the present invention. One preferred method is to intimately mix the ingredients by ball milling under an appropriate solvent such as methylene chloride. The admixture is then dried and pressed into pellets.

The pyrotechnic compositions of this invention may be employed with any suitable gas generator apparatus for use inflating a variety of inflatable devices, preferably vehicle occupant restrain devices, such as air bags.

In order to further describe the present invention, the following non-limiting examples are given.

EXAMPLE 1

A composition consisting of 0.5 wt.% carbon black, 4.0 wt.% polyethylene having a density of 0.965, 24 wt.% calcium hydroxide, and 71.5 wt.% sodium chlorate was intimately mixed under methylene chloride, dried, and pressed into pellets. The aforementioned weight percents are based on the total weight of the composition.

The pellets were pressed into a slug measuring about 2 inches long and 1 inch in diameter. The slug was inserted into a cylindrical steel casing and the exposed end of the slug, to which a nozzle was attached, was ignited. A burn rate of 0.6 inches per second at 1000 psi was measured. This rate is acceptable for safety restraint pyrotechnic compositions wherein any rate over about 0.5 inch per second is generally acceptable. The calculated flame temperature was found to be 2250° F.

It is to be understood that variations and modifications of the present invention may be made without departing from the scope thereof. It is also understood that the present invention is not to be limited by the specific embodiments disclosed herein but only in accordance with the appended claims when read in light of the foregoing specification.

What is claimed is:

1. A pyrotechnic composition for the generation of a non-toxic, non-flammable and essentially smokeless inflating gas for an inflatable occupant safety restraint, said composition comprising, in approximate weight percent based on the total weight of the composition, (a) 1 to 10% of a high density homopolymer of ethylene, having a density of about 0.92 to 0.97 at 23° C. as determined by ASTM Method D 792;

(b) 20 to 30% of a coolant selected from the group consisting of calcium hydroxide, magnesium hydroxide, calcium carbonate and magnesium carbonate, and (c) 60 to 79% of an inorganic oxidizer selected from the group consisting of sodium chlorate, potassium chlorate, sodium perchlorate and potassium perchlorate.

2. The composition of claim 1 wherein the inorganic oxidizer is sodium chlorate.

3. The composition of claim 2 wherein the coolant is calcium hydroxide.

4. The composition of claim 3 wherein about 0.5 to 1.5 wt.% carbon black is present.

5. The compositon of claim 3 wherein the ethylene homopolymer—and the period following "present" has been changed to—in an amount of from about 3 to 5 wt.% is present.

* * * * *

UNITED STATES PATENT AND TRADEMARK OFFICE

CERTIFICATE OF CORRECTION

PATENT NO. : 4,203,786

DATED : May 20, 1980

INVENTOR(S) : Eugene F. Garner

It is certified that error appears in the above-identified patent and that said Letters Patent are hereby corrected as shown below:

Column 1, line 66, "composition" should read -- combustion --.

Claim 5, following "homopolymer", delete "---and the period following "present" has been changed to--" and insert therefor "is present".

Claim 5, following "wt.%", delete "is present".

Signed and Sealed this

*Twenty-first* Day of *October 1980*

[SEAL]

*Attest:*

SIDNEY A. DIAMOND

*Attesting Officer*

*Commissioner of Patents and Trademarks*